US007303020B2

(12) United States Patent
Bishop et al.

(10) Patent No.: US 7,303,020 B2
(45) Date of Patent: Dec. 4, 2007

(54) INTERVENTIONLESS OIL TOOL ACTUATOR WITH FLOATING PISTON AND METHOD OF USE

(75) Inventors: Floyd Romaine Bishop, Humble, TX (US); Richard J. Ross, Houston, TX (US); Marvin Bryce Traweek, Houston, TX (US)

(73) Assignee: BJ Services Company, Houston, TX (US)

( * ) Notice: Subject to any disclaimer, the term of this patent is extended or adjusted under 35 U.S.C. 154(b) by 234 days.

(21) Appl. No.: 11/049,126

(22) Filed: Feb. 2, 2005

(65) Prior Publication Data

US 2006/0169462 A1 Aug. 3, 2006

(51) Int. Cl.
*E21B 23/08* (2006.01)

(52) U.S. Cl. ..... 166/374; 166/386; 166/319; 166/323; 166/324; 166/332.1

(58) Field of Classification Search ..... 166/374, 166/373, 386, 316, 319, 323, 324, 332.1, 166/332.3, 334.1, 334.2
See application file for complete search history.

(56) References Cited

U.S. PATENT DOCUMENTS 5,810,087 A 9/1998 Patel
5,950,733 A 9/1999 Patel
5,984,014 A * 11/1999 Poullard et al. ..... 166/374
6,125,930 A 10/2000 Moyes
6,227,298 B1 5/2001 Patel
6,230,808 B1 5/2001 French
6,352,186 B1 3/2002 Patel
6,516,886 B2 2/2003 Patel
6,659,186 B2 12/2003 Patel
6,662,877 B2 12/2003 Patel

OTHER PUBLICATIONS

Weatherford, CIV/RM Completion Isolation Valve, Jul. 3, 2000, 12 pages.
Schlumberger, FIV Technology, Feb. 2003, 8 pages, www.slb.com/oilfield.
Aker Maritime, Full Bore Isolation Valve (FBIV), undated, 2 pages.

* cited by examiner

*Primary Examiner*—Lanna Mai
*Assistant Examiner*—Matthew J. Smith
(74) *Attorney, Agent, or Firm*—Locke Lord Bissell & Liddell LLP

(57) ABSTRACT

An interventionless actuator for oil well tools is described wherein the actuator comprises at least one floating piston adapted to equalize a pressure differential and lock onto an actuating member. An interventionless actuator is described that is charged to an initial energy level less than the expected at-depth well pressure and then recharged down hole to approximately the at-depth well pressure by a floating piston. At the time of desired interventionless actuation, the actuator is overcharged to a pressure greater than the at-depth well pressure, which pressure is reacted by an actuating piston to generate an actuating movement.

26 Claims, 12 Drawing Sheets

INTERVENTIONLESS OIL TOOL ACTUATOR WITH FLOATING PISTON AND METHOD OF USE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

This disclosure relates generally to an interventionless actuator for oil well tools and, more particularly, to an interventionless actuator having a floating piston.

2. Description of the Related Art

A typical hydrocarbon well, whether on land or under water, is drilled into the earth's surface to form a well bore. A protective casing may be run into the well bore and the annulus formed between the casing and the well bore filled with a concrete-like mixture. Several types of tools may be run into the cased well bore to complete the well and subsequently produce hydrocarbons from the well. Most of these tools and equipment require that one or more actuating events occur. For example, mechanical actuation can be accomplished by physically pushing, pulling or rotating one or more parts of the down hole equipment. For example, a mechanical well or formation isolation tool may use a shifting tool to open and/or close the isolation element. Such mechanical actuation requires intervention into the well bore and such intervention is often times undesirable. In response, the industry has developed interventionless tool actuators that, as the name implies, do not require mechanical access to the well bore.

In the context of well isolation tools, U.S. Pat. No. 6,662,877 discloses mechanical actuation in the form of a shifting tool that is used to mechanically move a sleeve, which in turn causes the isolation element to transition from closed state to an opened state, and vice versa. This patent also discloses interventionless actuation to open the closed valve element. The interventionless actuator comprises a nitrogen chamber and an indexing mechanism. Repeated pressurization and depressurization of the inside of the tool causes the isolation element to open after a predetermined number of pressure cycles advance the indexing mechanism. To provide the necessary actuation energy, the nitrogen chamber must be charged at the surface to a pressure at least greater than the hydrostatic pressure to be encountered in the well, which may be 8 to 10 kpsi or higher. Such high pressure charging and equipment is potentially dangerous and often times undesirable on the rig floor.

This application for patent discloses an improved interventionless actuator for oil well tools.

BRIEF SUMMARY OF THE INVENTION

In one aspect of the invention, an interventionless actuator for an oil well tool is provided, which comprises a housing having an actuating member fixed relative to the housing and adapted to translate relative to the housing once the fixation is released. A chamber is formed within the housing and is adapted to receive at least one floating piston, which is adapted to equalize a pressure differential across it. A directional lock is provided having one portion on the actuating member and another portion on the at least one piston for locking the piston and member together at a predeterimined time. The actuating member is translated relative to the housing by a pressure differential acting upon the at least one piston when it is locked to the member.

In another aspect of the invention, an interventionless actuator for subterranean well equipment is provided, which comprises a housing having an actuating sleeve adapted to physically actuate the equipment. A fluid chamber is disposed in the housing and a first piston is disposed within the chamber, which divides the chamber into a first part for containing well fluid and a second part for containing a compressible fluid. A second piston is disposed within the chamber and is releasably fixed in position relative to the housing, the second piston comprises a portion of a lock, which is not engaged when the second piston is in the fixed position. A corresponding portion of the lock is disposed on the actuating sleeve such that when the second piston is freed from its fixed position, the lock portions engage and fix the second piston to the actuating sleeve to form an actuating assembly. The actuating assembly is responsive to differential pressure between the compressible fluid and well fluid pressure to provide interventionless actuation of the equipment.

In another aspect of the invention, an interventionless well isolation tool is provided that comprises a first chamber pressurizable to a first level from outside the tool, a second chamber pressurizable to a second level greater than the first level by well fluids and a floating piston separating the two chambers and adapted to move within the chambers to equalize the pressures in the two chambers. A second floating piston releasably locked to the tool, and comprises a working surface and a locking portion. An actuation member is adapted to actuate an isolation element disposed in the tool for isolating a tool flow path. The actuation member has a locking portion adapted to engage the locking portion on the second floating piston when the second piston is unlocked from the tool.

Another aspect of the invention is a method of interventionlessly actuating a subterranean oil well device, which comprises charging a first chamber to a first pressure level with a compressible fluid, charging a second chamber to a second pressure level which is greater than the first pressure level, equalizing the pressures in the first and second chambers across a floating piston located in the chambers, sealing the equalized pressures in the two chambers, unlocking a second piston from its initial position, fixing the second piston to an actuating member, moving the actuating member in response to a pressure differential acting on the second piston, and actuating the device based on the movement of the actuating member.

Figure 1:
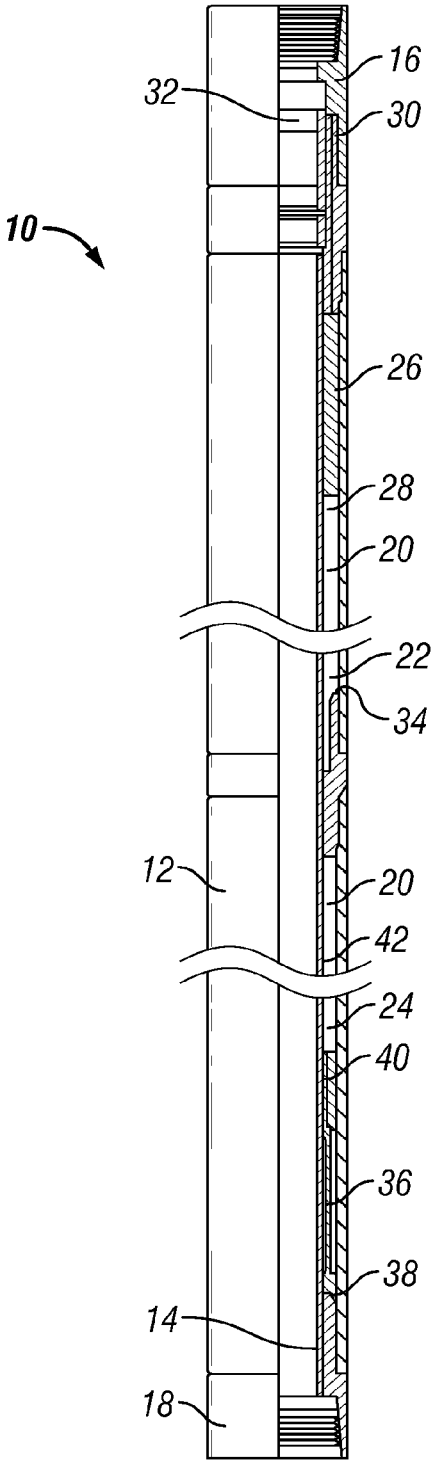
FIG. 1 illustrates an embodiment of an interventionless actuator according to the present invention.

While the inventions disclosed herein are susceptible to various modifications and alternative forms, only a few specific embodiments are shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art as required by 35 U.S.C. § 112.

DETAILED DESCRIPTION

One or more illustrative embodiments incorporating the invention disclosed herein are presented below. Not all features of an actual implementation are necessarily described or shown for the sake of clarity. For example, the various seals, vents and others design details common to oil well equipment are not specifically illustrated or described. It is understood that in the development of an actual embodiment incorporating the present invention, numerous implementation-specific decisions must be made to achieve the developer's goals, such as compliance with system-related, business-related and other constraints, which vary by implementation and from time to time. While a developer's efforts might be complex and time-consuming, such efforts would be, nevertheless, a routine undertaking for those of ordinary skill the art having benefit of this disclosure. Also, the use in this application of relative terms, such as, but not limited to, left, right, up, down, inside and outside, is not meant to preclude interchanging one for the other in other embodiments. Such relative terms are merely used for clarity of discussion of the particular embodiments disclosed herein.

In general terms, an interventionless actuator has been created, which may be used with a variety of different tools, devices and equipment, and may be implemented in a variety of different ways through a variety of different structures. The interventionless actuator comprises an integral energy source, which is responsive to tubing pressure to provide the required actuation. The energy source is charged to a first energy level prior to running the actuator down hole. Once at depth, the energy level may be increased, if necessary, in response to well pressure to a second, higher energy level. The first energy level or the second energy level, if present, may then be used, when desired, to actuate a tool or device without having to mechanically intervene into the well.

More particularly, the present invention comprises charging the actuator to a first energy level approximately equal to the energy level of the well at-depth. Prior to interventionless actuation, the energy level in the actuator may be overcharged or increased above the energy of the well to provide the necessary actuation energy for an associated tool. In this way, the present invention minimizes the amount of time that an energy differential exists between the well and the actuator and minimizes the initial energy charge required for the actuator.

For purposes of disclosing the present invention, embodiments of an actuator that are useful with well isolation tools (WITs) will be described. It is to be understood that the subject invention is not limited for use only with well isolation tools, generally, or with the specific well isolation tool embodiments described herein. Rather, it will be appreciated once the embodiments presented herein are described that the interventionless actuator may be used with numerous other tools, devices and equipment.

For purposes of these detailed descriptions, all pressures discussed herein are stated in terms of pounds-per-square-inch (psi) or thousand-pound-per-square-inch (kpsi) as seen by the actuator and referenced to atmospheric pressure at the wellhead, unless otherwise noted. For example, a well may have a down hole pressure at the depth of interest of 10,000 psi caused by, for example, hydrostatic pressure. The pressure of the well at the wellhead may be 0 psi. When the actuator described herein is at depth it "sees" the 10 kpsi hydrostatic pressure, despite the wellhead indicating 0 psi well pressure. In this example, increasing the at-depth well pressure to 13,000 psi requires adding 3,000 psi of pressure at the wellhead.

Turning now to FIG. 1, an interventionless actuator 10 useful with many different tools, devices and equipment will be described. The interventionless actuator 10 comprises, generally, a cylindrical structure having an outside surface, such as that formed by a housing 12 and an inside surface, such as that formed by an actuating sleeve 14. The outside surface is typically adapted not to move axially or rotationally relative to the overall device, but may in certain embodiments. In contrast, the actuating sleeve 14 is adapted to move axially and/or rotationally with respect to the device 10. In a preferred embodiment, it is these axial and or rotational movements of the actuating sleeve 14 that are used to actuate the corresponding tool, device or equipment (not shown). The actuator 10 may comprise conventional top and bottom subs 16, 18 for connecting to other tools and equipment. The actuator housing 12 may be a unitary structure or comprised of several discrete sections. A preferred embodiment of the actuator 10 utilizes a multi-part housing 12 to aid the manufacture and assembly of the actuator 10.

The actuator 10 may also comprise a chamber 20 disposed within the device, and preferably between the housing 12 and the actuating sleeve 14, for containing the energy source. In the embodiment illustrated in FIG. 1, the energy source is in the form of a compressible fluid, preferably a pressurized gas, and more preferably compressed nitrogen. The chamber 20 is sealed and/or sealable to contain and maintain the energy source. The chamber 20 may be divided into one or more sections, each of which may or may not be sealed or sealable as against the others. In the embodiment of FIG. 1, the chamber 20 comprises an upper section 22 and a lower section 24.

The interventionless actuator 10 may also comprise a floating piston 26, preferably, but not necessarily, disposed within the upper chamber section 22. The floating piston 26 effectively divides its pressure compartment, such as the upper chamber section 22, into two sub-chambers. Each sub-chamber may be pressure sealed or sealable. In the embodiment of FIG. 1, the lower sub-chamber 28 (i.e., the pressure compartment down hole from the floating piston 26) is adapted to receive, contain and maintain the energy source, which in this embodiment is nitrogen gas. The second or up hole sub-chamber (not show in FIG. 1) is adapted to receive and contain well fluid. In the preferred embodiment, the upper sub-chamber is adapted to receive tubing side well fluid and has a port 30 sealable from the inside (or tubing) surface of the actuator 10. In FIG. 1, the sealable port 30 comprises a sealing sleeve 32 that is moveable from an opened position to a closed, sealed position. In other embodiments, the upper sub-chamber may be adapted to receive annulus well fluid or a combination of both.

The lower sub-chamber 28 (or nitrogen chamber) also comprises an unloader 34 to release the stored energy source at an appropriate time. In the preferred embodiment illustrated in FIG. 1, the unloader 34 is a mechanical vent located in the nitrogen chamber 28 and adapted to vent the nitrogen gas into the tubing. In other embodiments, the vent 34 could also direct the compressed fluid to the annulus or outside of the tool. The structure and functioning of the unloader 34 will become more apparent when the operation of the actuator 10 is described below in more detail.

The chamber 20 may also comprise an actuating piston 36 that is responsive to well pressure. In the embodiment of FIG. 1, the actuating piston 36 is disposed in the lower compartment 24 and is initially releasably affixed the actuator 10 (such as the housing 12) by a shearable pin 38. The actuating piston 36 may also comprise a lock portion 40. A corresponding lock portion 42 may be disposed on the actuating sleeve 14. In the actuating piston's initial, unreleased position, the two lock portions 40, 42 are not engaged.

In operation, the interventionless actuator 10 of the present invention may be charged to a first energy level in the field (i.e., out of hole) and then charged or otherwise manipulated to a second, greater level down hole to provide substantially all of the energy necessary for actuation. For example, in the embodiment shown in FIG. 1, the actuator tool 10 may be charged in the field by filling the lower sub-chamber 28 (or nitrogen chamber) with approximately 5,000 psi pressure of nitrogen gas, or to some other reasonable pressure equal to or less than the expected pressure of the well at the depth of interest (e.g., hydrostatic pressure). In this initially charged condition, the compressed gas forces the floating piston 26 upwards to the end of the upper compartment 22. The sealing sleeve 32 is locked in position such that the upper sub-chamber port 30 is open to atmosphere. One or more temporary locks, such as shearable pins 38, fixes the actuating piston 36 relative to the actuator 10 and the actuating sleeve 14 is disposed within the tool 10 as shown in FIG. 1.

Once the tool 10 has been run in, the actuator system may be charged to the second energy level. For example, assuming that the well pressure at depth is 10,000 psi and because upper sub-chamber port 30 is open to well pressure, the upper sub-chamber 29 (FIG. 3) fills with about 10 kpsi of well fluid, which cause the floating piston 26 to equalize the pressures in the two upper compartment 22 sub-chambers 28, 29. In other words, the nitrogen gas in the nitrogen chamber 28 has been additionally charged or manipulated to a second energy level of approximately 10 kpsi. The sealing sleeve 32 may be unlocked and moved into position, such as by running in or removing a tool having the corresponding profile, to seal the upper sub-chamber port 30 and lock in the pressurized well fluid. The 10-kpsi nitrogen charge is contained and maintained in the nitrogen chamber 28 until it is needed for actuation. It will be appreciated that so long as the well pressure adjacent the actuator is about the same as the nitrogen gas pressure (i.e., a small pressure differential) loss of nitrogen gas pressure is minimized.

When an interventionless actuation is needed, the well pressure at depth is increased to a predetermined level, such as 13 kpsi. This increased well pressure acts on the actuating piston 36 and causes the pin 38, or other locking structure, to shear, which releases the actuating piston 36 from its fixed position. The pressure differential causes the actuating piston 36 to travel upwards compressing the trapped well fluid to the new pressure level (e.g., 13 kpsi), which, in turn, compresses the nitrogen gas to the new pressure level (e.g., 13 kpsi).

As the actuating piston 36 travels upward, its lock portion 40 engages the lock portion 42 on the actuating sleeve 14, effectively "locking in" the overcharge or actuation pressure. When the well pressure is reduced, such as to 10 kpsi, the pressure differential between the 13 kpsi nitrogen gas and well fluid propel the actuating piston 36 downward. Because the actuating piston 36 is locked to the actuating sleeve 14, at least in the down hole direction, the actuating sleeve 14 is propelled downward as well. This downward movement of the actuating sleeve 14 may be used to actuate a tool, device or other equipment without intervening in the well. The downward movement of the sleeve 14 also dislodges the unloader 34 from its sealed position and vents the nitrogen gas into the well. It will be appreciated that the axial movement of the actuating sleeve 14 can be converted into rotary motion through various well-known structures, such as camming surfaces or pins and grooves. The desired actuation motion (such as axial or rotary) is an element of design choice within the concept of the present invention and well within the ordinary skill of those having benefit of this disclosure.

Figure 2:
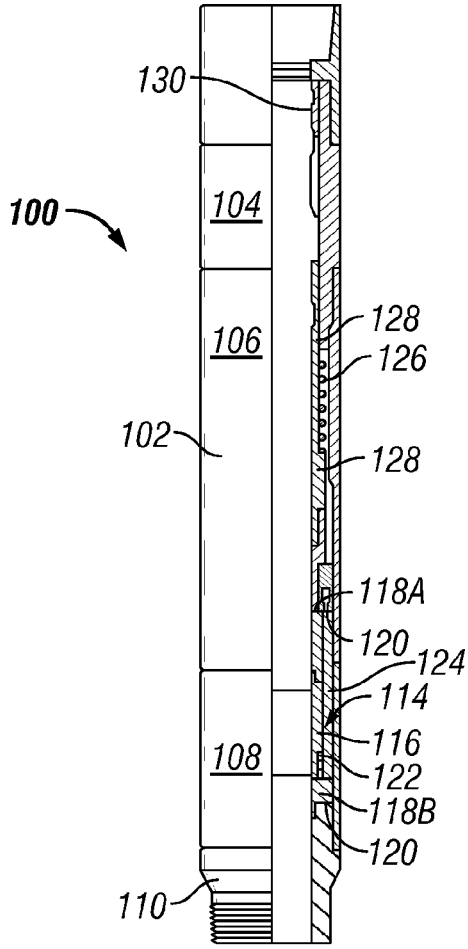
FIG. 2 illustrates a well isolation tool (WIT) that may be used in conjunction with an interventionless actuator according to the present invention.

Turning now to FIG. 2, one such tool, device or equipment that may be actuated by the present invention will now be described. The well isolation tool (WIT) 100 illustrated in FIG. 2 generally comprises a bi-directional, mechanical ball valve. The WIT 100 may comprise a cylindrical housing 102 typically having one or more segments, such as a shifting sub 104, a bias housing 106, a valve element housing 108 and a bottom sub 110. It will be appreciated that a top sub 112 may be coupled to the threads on the shifting sub 104 as desired. The top and bottom subs 112, 110 may be conventional in design having threads for connection with other tools or tubing. Located within the housing 102, such as the valve element housing 108, is an isolation element 114. The isolation element 114 may have a plurality of states, two of which may be defined as an open state in which fluid and/or mechanical communication across the element 114 may occur and a closed state in which such communication is prevented. In a preferred embodiment, such as the one illustrated in FIG. 2, the isolation element 114 is a ball 116 with corresponding seats 118, which allow the ball/seat assembly 114 to seal in both directions. In other words, in a preferred embodiment, the isolation element 114 may seal against down hole fluid flow (flow in the direction of the shifting sub 104 to the bottom sub 110) and against up hole fluid flow (flow in the direction of the bottom sub 110 to the shifting sub 104). Numerous other isolation elements 114 may be used, such as, for example, flap valve and sleeve valves. FIG. 2 illustrates the isolation element 114 in the open state.

The WIT 100 shown in FIG. 2 comprises upper and lower seats 118*a*, 118*b* configured to create a metal-to-metal high-pressure seal against the outside surface of the ball 116. The seats 118 are biased against the ball 116 to facilitate the sealing engagement. In a preferred embodiment, the biasing elements 120 may comprise a wavy washer or wave spring. Although referred to herein as a ball 116, it is to be understood that the ball 116 is not truly ball-shaped. Indeed, the ball 116 preferably has two flat portions on the outside surface, one of which is shown in FIG. 2. The flat surfaces serve to orient the ball 116, more particularly the flow path through the ball, and to prevent the ball 116 from becoming disoriented. These flat surfaces may also include an interface portion 122 to which one or more shifting linkages 124 may cooperate.

As illustrated in FIG. 2, the state of the ball 116 is controlled by one or more shifting linkages 124, which are configured adjacent one end to couple with the linkage interface portion 122 on the ball 116. The shifting linkage 124 is adapted to translate axially with respect to the tool 100 and physically transition the ball 116 between states. In the embodiment illustrated in FIG. 2, moving the shifting linkage 124 in a down hole direction causes the ball 116 to open and moving the shifting linkage 124 in an up hole direction causes the ball 116 to close. A biasing element 126, such as a spring, acts on the shifting linkages 124, which in turn act on the isolation element 114, as described above, to bias the isolation element 114 in the open state.

A closing sleeve 128 may be provided to interface with the shifting linkages 124 to facilitate actuation of the shifting linkage 124 and closure of the ball 116. Such closing sleeve 128 may be located on the inner surface of the tool 100 and adapted to slide relative to the tool 100 in an axial or lengthwise direction. A separate mechanical activation tool or shifting tool (not shown) may interface with the closing sleeve 128 and cause it to slide in an up hole direction, thereby transitioning the isolation element 114 from the biased-opened state to the closed state. The design of the closing sleeve 128, shifting linkage 124 and isolation element 114 are such that, once closed, the isolation element 114 will not transition back to the biased-open state without additional activation, despite the bias of element 126.

Such additional activation may take the form of an opening sleeve 130 disposed with the housing 102 and adapted to cooperate with the shifting linkage 124 to transition the isolation element 114 from the closed state to the opened state. Alternately, the opening sleeve 130 may cooperate with closing sleeve 128, which in turn cooperates with shifting linkage 124 to open the isolation element 114. Similarly to the closing sleeve 128, the opening sleeve 130 is adapted to slide axially relative to the housing 10. The mechanical activation tool or a different tool (e.g., an opening tool not shown) may be used to activate the opening sleeve 130 and thereby open the closed isolation 114. In the preferred embodiment, the closing sleeve 128, opening sleeve 130 and activation tool comprise the mechanical actuation system. It will be appreciated that the mechanical actuation system requires physical intervention into the well, such as tripping the mechanical activation tool into the well.

Figure 3:
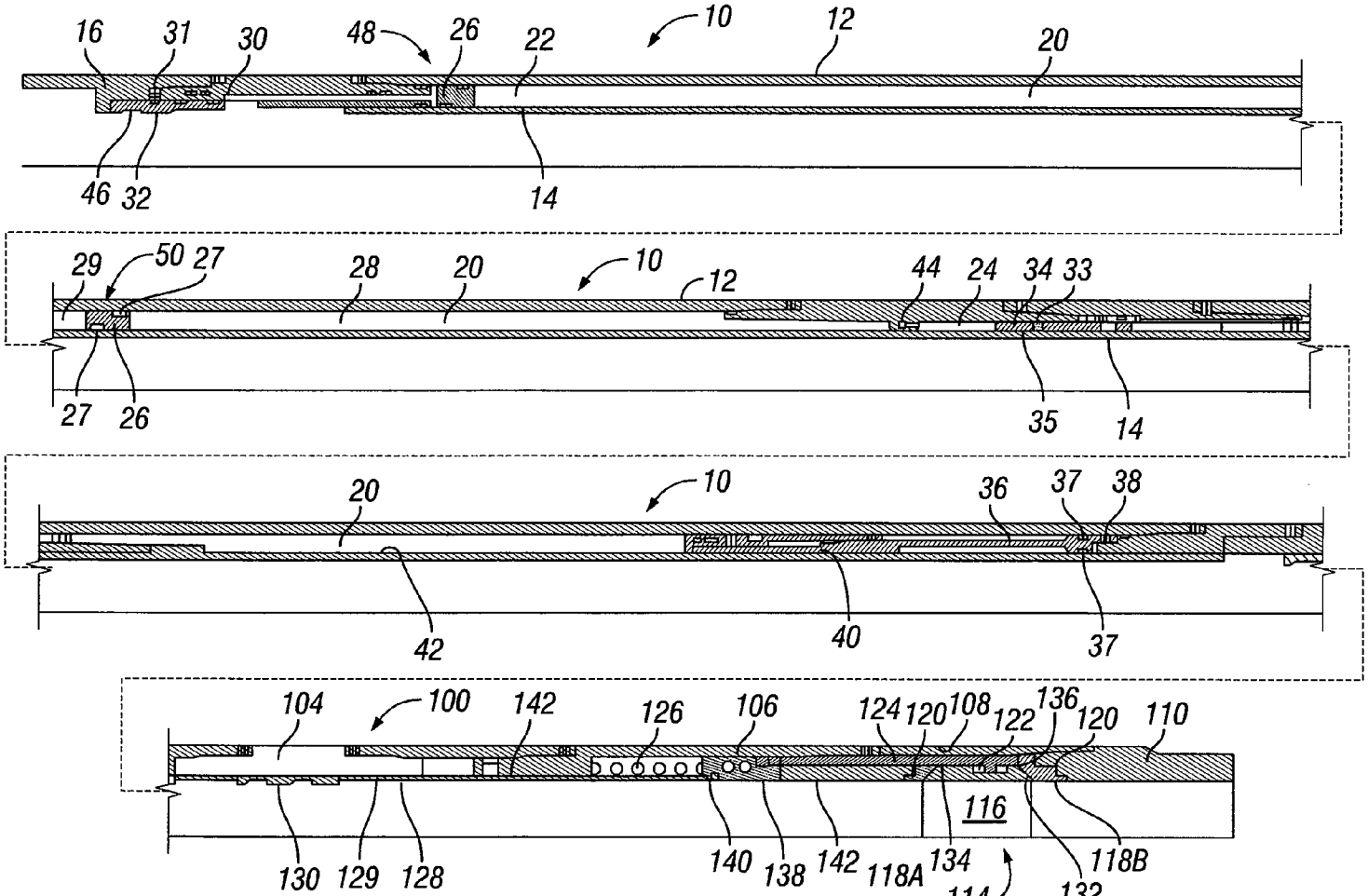
FIG. 3 illustrates a more detailed embodiment of an interventionless well isolation tool in an initial state.
Figure 4:
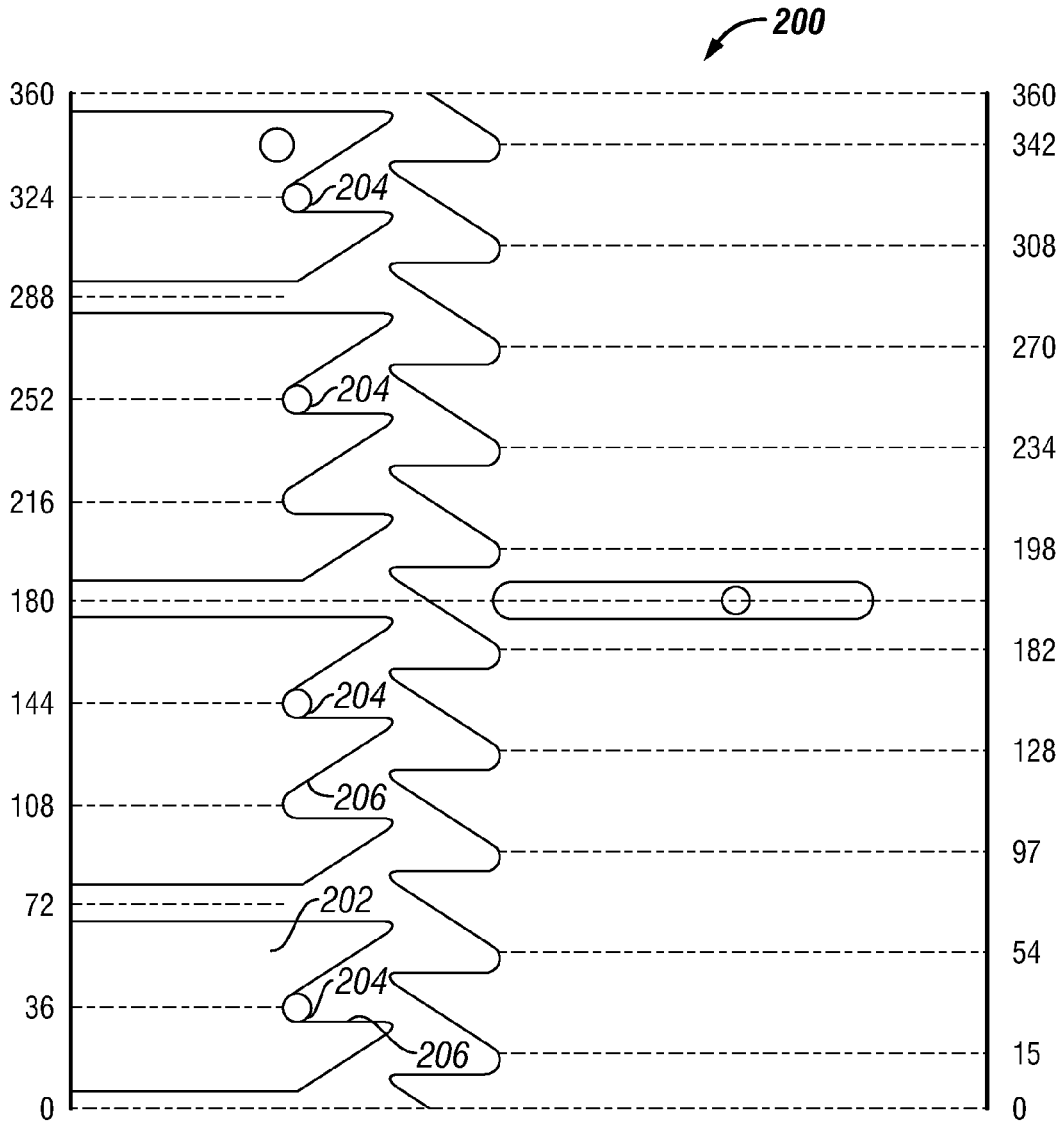
FIG. 4 illustrates an embodiment of an indexing system that may be used with an interventionless actuator according to the present invention.

Turning now to FIGS. 3-8, a more detailed description of a preferred embodiment of the present invention coupled to a WIT will be presented. As shown in FIG. 3, the isolation element 114 may comprise a ball 116 (shown in the biased-open state) and upper and lower seats 118*a* and 118*b*. Ball 116 and seats 118 may be fabricated from any number of corrosion resistant materials, such as metals or composites, and in the preferred embodiment are made from a chromium carbide alloy. The seats 118 may be biased into sealing engagement with the ball 116 by any number of means well known in the art, including a biasing element 120, such as a wavy washer or wave spring. Lower seat 118*b* may also comprise a low-pressure gas-tight seal 132. It will be appreciated that ball 116 and seats 118 may be positively located in tool 100 by housing 102 (including bottom sub 110), such that the ball 116 "floats" on the seats 118 within the housing 102 and need not be, although it can be, pivotally attached to the tool 100. The ball 116 illustrated in FIGS. 3-8 is not completely or even substantially spherical in shape. It can be seen that ball 116 has axial surfaces 134, which are substantially flat and serve to keep the ball properly oriented with respect to the housing 102.

Shifting linkage 124 is illustrated in FIG. 3 as comprising a shifting rod (note that 2 shifting rods are used in the preferred embodiment, about 180 degrees apart) having a ball interface portion 136 on one end. The ball interface portion 136 may comprise a protrusion or pin that mates with a corresponding interface portion 122, such as a track or groove in the axial face 134 of ball 116. The interface portions 136, 122 are constructed such that axial movement (relative to the housing) creates the desired rotary motion of the ball, allowing the ball 116 to rotate between the opened and closed states, and vice versa.

The shifting linkage 124 may also comprise an annular clamp ring 138. The clamp ring 138 may be comprised of multiple sections to aid in the assembly of the tool 100, and in the preferred embodiment, clamp ring 138 comprises two halves joined together by circumferential fasteners. The clamp ring 138 is adapted to mate with the other end of shifting linkage 124 to hold them securely therein. Among other things, clamp ring 138 may provide a reaction surface for biasing element 126 and help to evenly spread the biasing load to shifting linkage 124. The other end of biasing spring 126 reacts against a portion of the housing 112.

Still on FIG. 3, the closing sleeve 128 is shown to have an inwardly facing tool profile 129 adapted to mate with a corresponding (but outwardly facing) profile on a mechanical activation tool (not shown in FIG. 3). It will be appreciated that because in the embodiment shown in FIGS. 3-8 the isolation element 114 is closed by translating the shifting linkage 124 in an up hole direction, the inward profile 129 of closing sleeve 128 is adapted to react this upward movement. Adjacent the end opposite the inward profile 129, the closing sleeve 128 has a clamping ring interface 140 for positively connecting with clamping ring 138. Closing sleeve 128 also may comprise a debris shield portion 142, which cooperates with a seal on the inside surface of housing 102 to prevent debris from accumulating in and around the shifting linkage 124 and biasing element 126 it will be appreciated that the length of the debris shield (e.g., the closing sleeve) may be varied as desired to provide protection in relatively clean or trashy wells. The outer surface of closing sleeve 128 may also comprise a releasable lock 142, such as a detent. Lock 142 has two positions, one for the open state and one for the closed state of valve element 20. FIG. 3 shows the closing sleeve 128 in the down position (or valve open) detent position.

FIG. 3 shows opening sleeve 130 in position up hole from closing sleeve 128. Opening sleeve 130 comprises an inwardly facing opening profile 132 adapted to interface with an opening tool, such as a mechanical activation tool, and react a down hole, isolation element 114 opening, force. It can be seen from FIG. 3 that in this embodiment, the opening sleeve 130 reacts against the closing sleeve 128, which in turn reacts against the shifting linkage 124 to actuate the isolation element 114.

Turning now to a detailed description of the structures illustrated in FIG. 3 comprising the interventionless actuator 10, this embodiment incorporating the present invention comprises a pressure sealed gas chamber 20, a floating piston 26 (shown in two positions in FIG. 3) an actuating sleeve 14, an actuating piston 36 and a chamber vent 34. Floating piston 26 may comprise a one-piece ring having seals 27 for sealing the gas chamber 20 above and below the piston 26 against the housing 12, on one side, and the actuating sleeve 14 on the other. The piston 26 is shown in its initial position (described more fully below) adjacent the top sub 16. Gas chamber 20 has a gas fill port 44 that permits fluid communication between the chamber 20 and the outer surface of actuator 10. The interventionless actuator system 10 also comprises a chamber vent system having a body portion 34 secured to the actuating sleeve 14 by one or more shearable pins 33.

In certain embodiments, an indexing or cycling system 200 may be provided comprising an indexing sleeve 202 positioned between the housing 12 and the actuating sleeve 14. The indexing system 202 may comprise (See FIG. 4) one or more pins or camming surfaces 204 associated with one or more grooves or tracks 206. In the embodiment illustrated in FIGS. 3-8, pins 204 are associated with the housing 12 and the corresponding tracks 206 are associated with the indexing sleeve 202. This pin 204 and groove 206 system is conventionally described as a J-track and permits up and/or down axial movement to generate a rotational motion. In this embodiment, the indexing sleeve 202 is associated with the actuating sleeve 14 and rotates relative to the housing 12 to present successive grooves pins 204. As described below in more detail, this allows the interventionless actuator 10 to be designed with an indexing system that prevents premature activation, if such feature is desired. It will be appreciated that numerous other indexing or cycling systems may be used, such as, for example, a ratchet mechanism or other such structure. In the preferred embodiment shown in FIG. 4, two pins 204 are load bearing at all times during indexing.

Returning to FIG. 3, the actuator 10 may also comprise an actuating piston, 36 which, in contrast to floating piston 26, may be initially fixed to housing 12 by an axial lock, such as a shearable pin 38. The actuating piston 36 may incorporate seals 37 for sealing the piston 26 against the housing 12 and the actuating sleeve 14. Actuating piston 26 also comprises a lock portion 40, such as a chevroned or wickered surface, on its inward facing surface. Actuating sleeve 14 also comprises a complementary part 42 of the lock. As illustrated in FIG. 3, in the initial configuration of actuator 10, the lock 40 of the actuating piston 26 is spaced apart from the complementary lock portion 42 of the actuating sleeve 14 and, therefore, the lock is not engaged.

The upper end of the actuating sleeve 14 is sealed against the housing 12 and, along with the other seals described above, helps to create the pressure sealed gas chamber 20. The portion of the chamber 20 up hole of the floating piston 64 (upper sub-chamber 29) may be ported to the inside of the actuator 10 by a port 30. Upper sub-chamber sealing sleeve 32 is shown in FIG. 3 in its initial, open position. An axial lock 31, such as a shearable pin, may be used to secure the sealing sleeve 32 in this initial position. The sealing sleeve 32 may have an inwardly facing tool profile 46 for interfacing with a tool, such as a mechanical activation tool. As described more fully below, an activation tool can be used to move the sealing sleeve 32 in a down hole direction to seal off the upper sub chamber 29 of the chamber 20 from the well environment. Having now described the various structures associated with a preferred embodiment of the present invention illustrated in FIG. 3, additional attributes and characteristics of the invention will be described for an isolation tool 100 utilizing an interventionless actuator 10 according to the present invention as it may be used in the field.

As described above, the embodiment shown in FIG. 3 is in its initial configuration. In the field or prior to shipment to the field, the gas chamber 28 may be filled with, preferably, an inert gas, such as nitrogen. Rather than requiring an initial gas charge that equals or exceeds the expected well pressure, such as hydrostatic pressure, (e.g., in the range of 10,000 to 15,000 psi), the actuator 10 may be charged initially to a much lower pressure, such as about 1,000 to about 7,000 psi and preferably to about 5,000 psi. Through conventional means, a nitrogen source may be connected to the gas chamber 28 by chamber fill port 44 and approximately 5,000 psi of nitrogen may be charged into the actuator 10. As shown in FIG. 3, this pressurization causes the floating piston 26 to travel to its farthest up hole extent in the chamber 20, shown as position 48. Note that upper sub-chamber 29 port 30 is open to atmospheric pressure. With that, the interventionless actuator 10 is ready for service with the WIT 100.

The interventionless WIT assembly 10, 100 may be placed into service in the tubing string at the desired location, such as up hole from a gravel pack, and run into the well. Once in place, the actuation energy in tool 10 can be increased as follows. Because sealing sleeve 32 is locked open, upper sub-chamber port 30 is open to pressurized well fluid, such as tubing pressure. By increasing the well fluid pressure to the desired increased charge pressure, the pressure in the nitrogen chamber 28 can be correspondingly increased. For example, if the hydrostatic pressure at depth is, for example, 10,000 psi, this pressure will be communicated through port 30 to the top surface of floating piston 26. The pressure differential between the nitrogen gas below the piston 26 (e.g., the initial charge of 5,000 psi) and the well fluid above the floating piston 26 will cause the floating piston to move to equalize the pressures. This is shown in FIG. 3 by the floating piston 26 at new position 50. The pressure in the gas chamber 20 has now been equalized with about 10,000 psi of well fluid above the piston 26 and about 10,000 psi of nitrogen below the piston 26.

Figure 5:
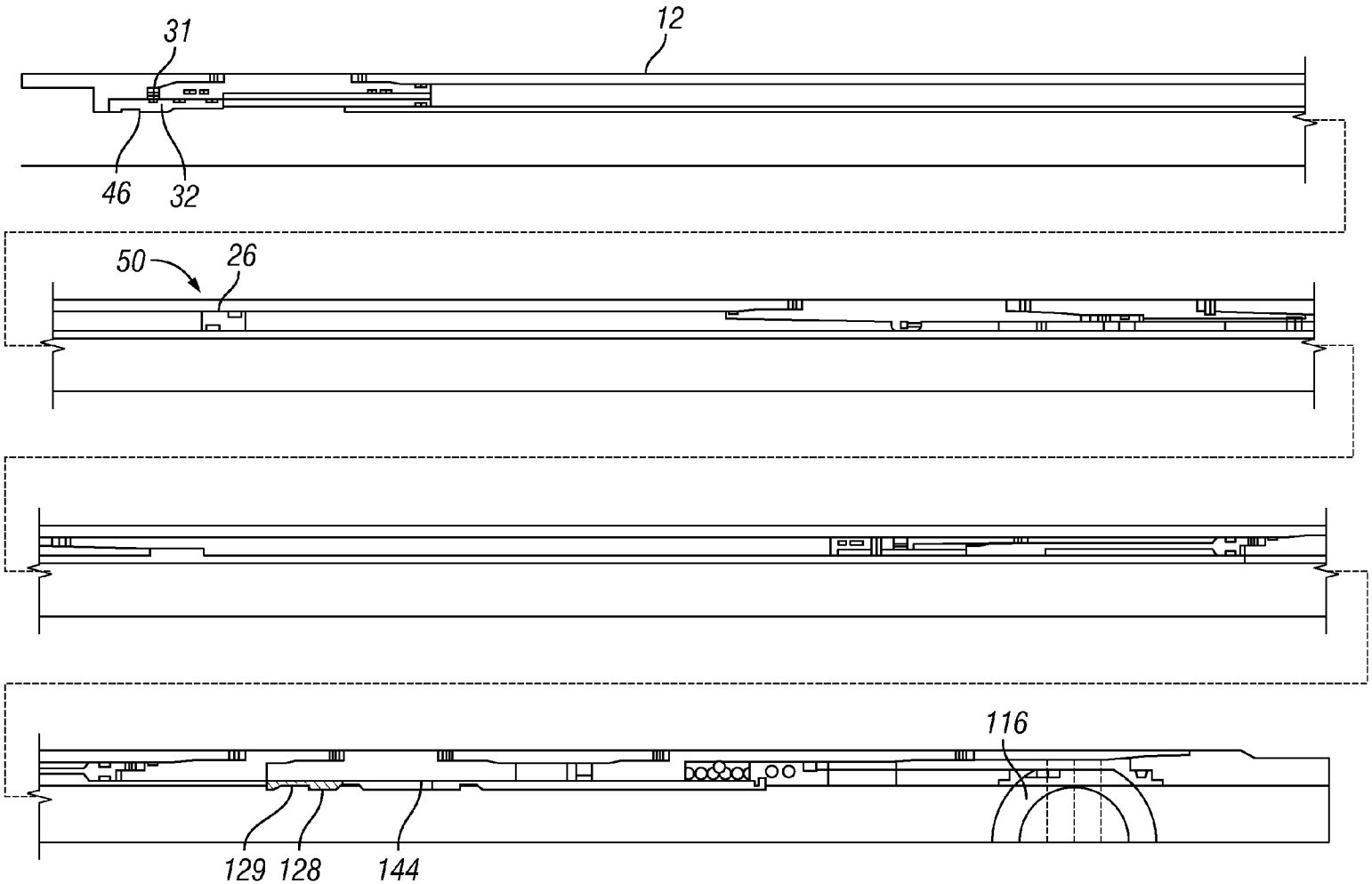
FIG. 5 illustrates the tool of FIG. 3 after the sealing sleeve has been closed and the gas chamber has been sealed.

In FIG. 5, a secondary tool, such as the mechanical activation tool or shifting tool, is run in the well. A profile on the secondary tool contacts the sealing sleeve profile 46. Continued travel of the tool causes the axial lock 31 holding the sealing sleeve 32 in the open position to fail, such as by shearing, and the sealing sleeve 32 is locked into place sealing the upper sub-chamber 29 from the well. Thus, the gas chamber 20 is completely sealed off with about 10,000-psi of nitrogen below the floating piston 26 and about 10,000 psi of well fluid above the floating piston 26. Of course, the increase charge pressure used will be a design choice base on the specific tool embodiment and the characteristics of the well being serviced.

The secondary tool may continue to be run in until a profile on the tool engages the profile 129 on the closing sleeve 128. Retracting the activation tool causes the closing sleeve 128 to slide axially with respect to the housing 102 and thereby compress the bias spring 126 as the isolation element 114 closes. When the isolation element 114 reaches its fully closed condition, continued retraction of the tool 10 causes the tool profile to contact stationary camming surface 144 and thereby release the closing sleeve profile 129. At this stage, the interventionless WIT system 10, 100 has been set and is ready for use. In the meantime prior to use, the WIT 100 may be mechanical actuated to repeatedly open and close the isolation element 114 as desired.

Figure 6:
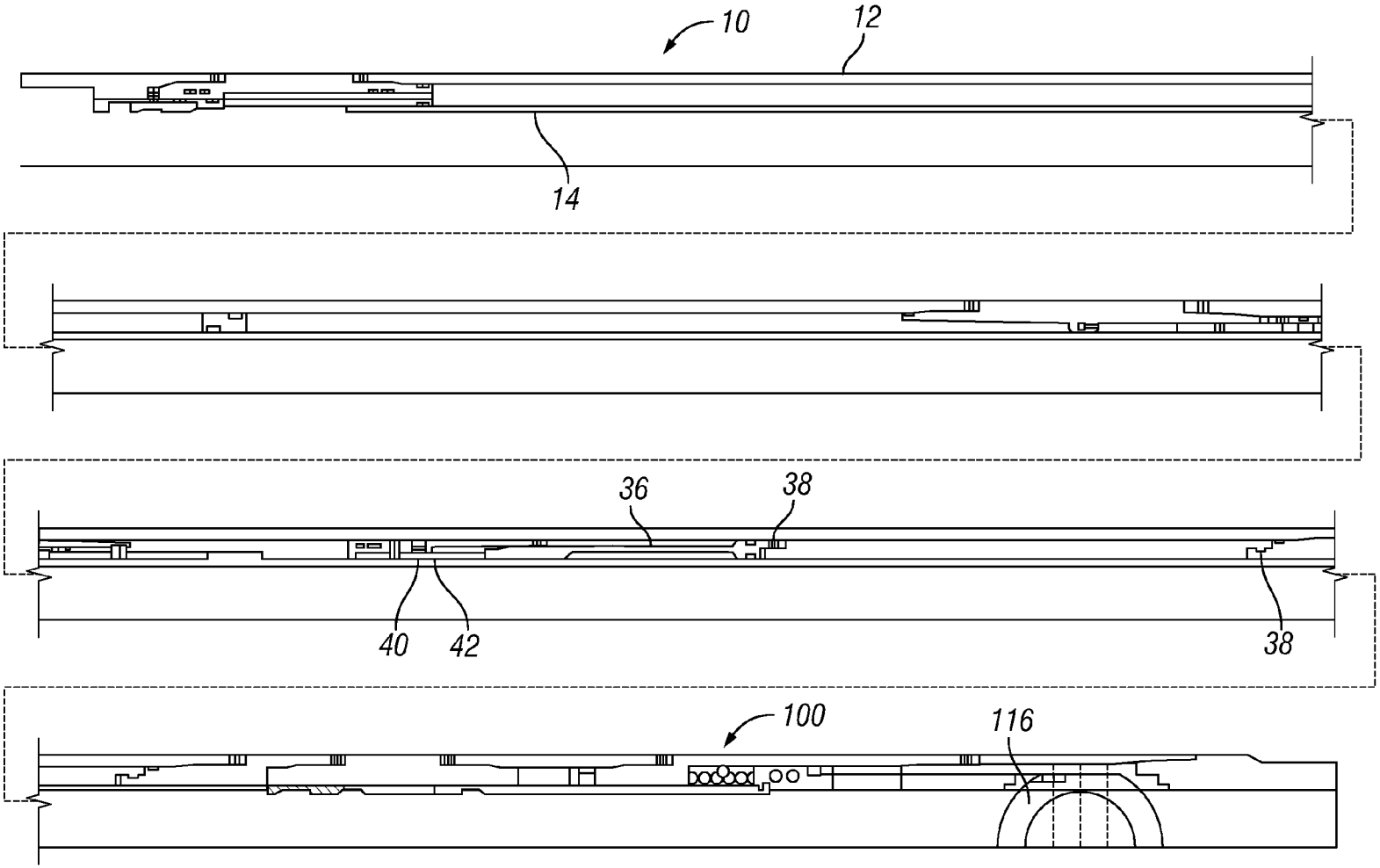
FIG. 6 illustrates the isolation tool of FIG. 5 after the actuating piston has been locked to the actuating sleeve.

Turning to FIG. 6, the present invention allows the operator to open the isolation element 114 without intervention, i.e. without opening the well. First, the actuating piston 36 may be unlocked from its fixed location to the housing 12 and is locked to the actuating sleeve 14. This may be accomplished by increasing the well pressure, e.g., tubing pressure, to some value greater than the pressure in the gas chamber 20 (e.g., greater than 10 kpsi) and to a pressure which is sufficient to unlock the actuating piston 26 from the housing 12, such as by shearing pin 38. For example, in the embodiment described herein, an at-depth tubing pressure of about 13,500 psi may be sufficient to free the actuating piston 36 from the housing 12. Once unlocked, the actuating piston 36 is free to move axially toward the floating piston 26 until the pressure above the floating piston and below the floating piston are equalized at about the tubing pressure (e.g., about 13,500 psi).

The axial movement of the actuating piston 36 causes the lock portions 40 on the piston 36 to engage the lock portions 42 on the actuating sleeve 14, thereby fixing the piston 36 to the actuating sleeve 14. The embodiment being described contemplates the use of an indexing system to prevent premature actuation and, therefore, the lock 40, 42 comprises a bi-directional lock that fixes the piston 36 to the actuation sleeve 14 in both the up hole and down hole directions. Embodiments that do not comprise an indexing system may utilize a unidirectional lock that fixes the piston 36 to the sleeve 14 in the actuation direction (e.g., down hole in the embodiment being described.)

Figure 7:
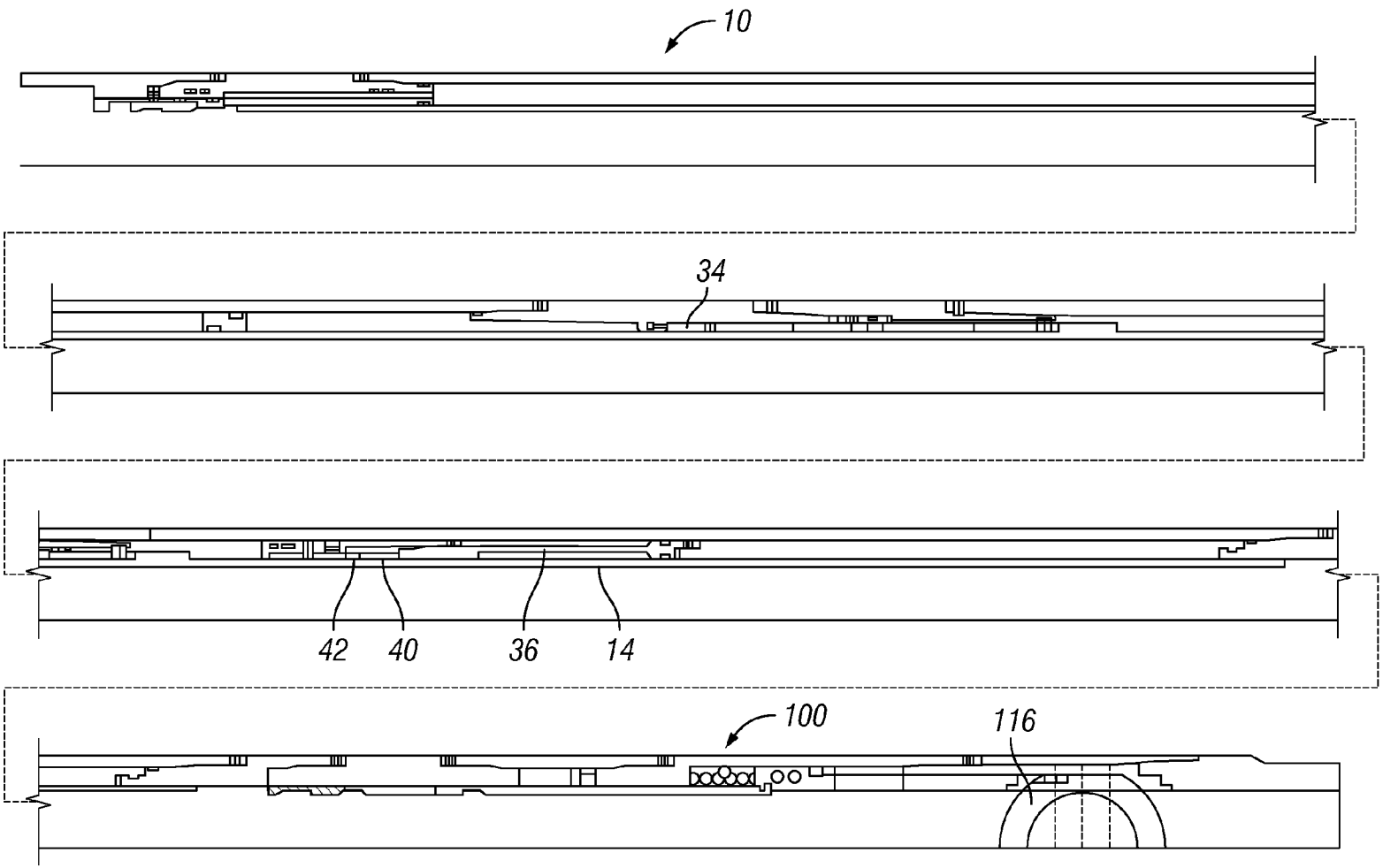
FIG. 7 illustrates the isolation tool of FIG. 6 after the actuating piston has been over pressurized to begin the indexing cycles.

Turning to FIG. 7, additional pressurization of the well ensures that the actuating sleeve/actuating piston assembly 14, 36 moves axially toward the top sub 16 and engage the first cycle of the indexing system 66. In the preferred embodiment, a pressure increase of about 300 psi (e.g., to about 13,800 psi) accomplishes this task. A subsequent reduction in tubing pressure of about 300 psi (e.g., to about 13,200 psi) causes the actuating sleeve/actuating piston assembly 14, 36 to complete the first indexing cycle. The actuator 10 may be designed to require a plurality of indexing cycles prior to allowing the isolation element 114 to open. In the preferred embodiment of FIGS. 3-8, the actuator 10 is constructed to require 9 pressure cycles prior to opening the ball 116. Each successive pressure cycle, that is, raising the tubing pressure to about 13,800 psi and then reducing it to about 13,000 psi, causes the indexing system to advance. After the ninth pressure cycle, reducing the tubing pressure to about 12,000 psi or lower, opens the ball valve 116.

Figure 8:
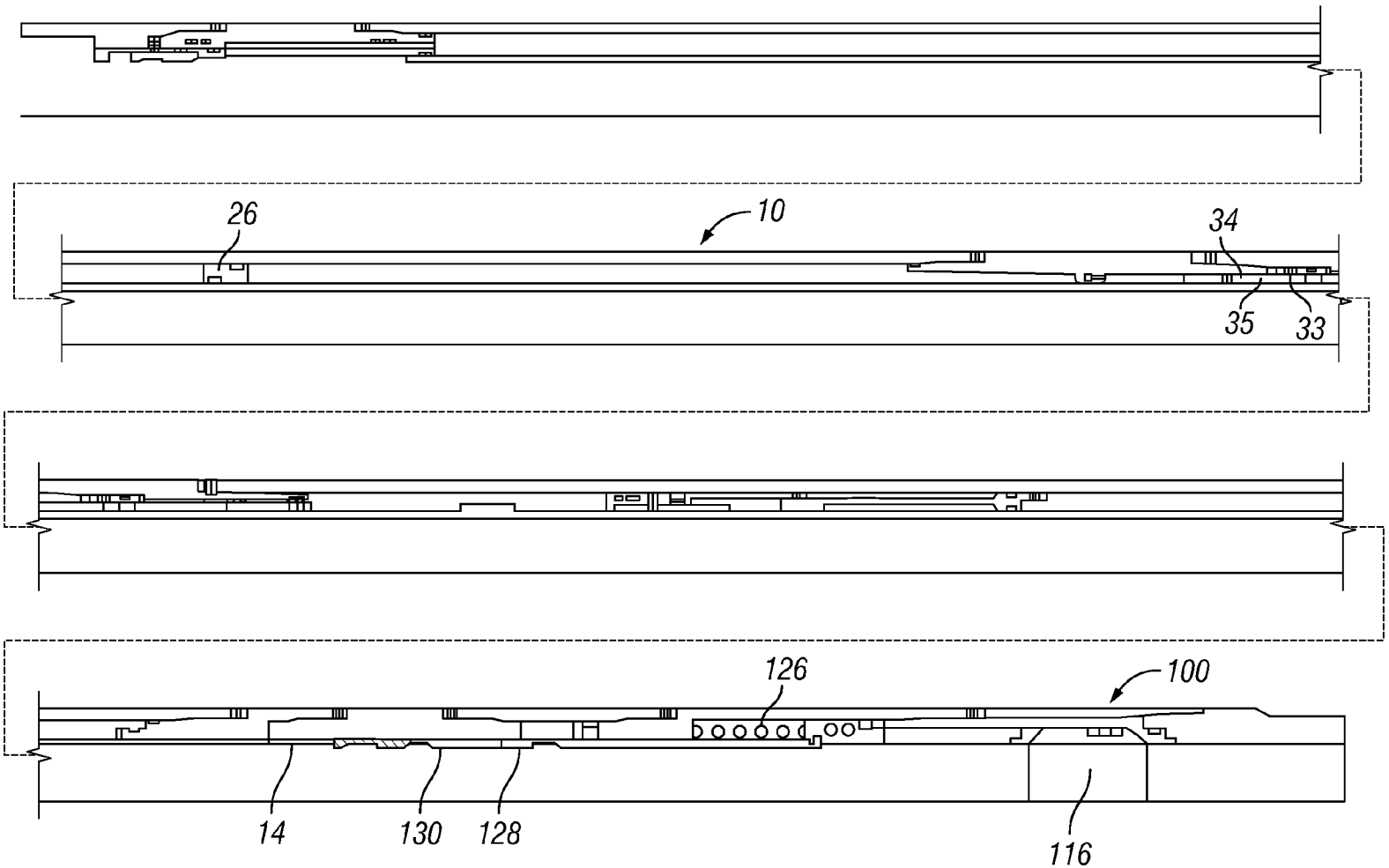
FIG. 8 illustrates the isolation tool of FIG. 7 after the well pressure has been decreased and the interventionless actuator is used to open the valve element.

Referring to FIG. 8, with the indexing system 200 no longer preventing full downward travel of the actuating sleeve 14, the existing pressure differential between the chamber 20 and the well causes the actuating sleeve 14 to travel axially downward and force the opening sleeve 130 into contact with the closing sleeve 128 and thereby cause the isolation element 114 to fully open. Simultaneously, or nearly so, the unloader 34 is caused to contact a portion of the actuator 10 and thereby unlock the unloader 34 from the actuating sleeve 14, such as by shearing the pin 33. As the unloader 34 is moved relative to the actuating sleeve 14, the vent becomes unsealed and allows the pressurized nitrogen below the floating piston 26 to escape into the tubing.

Thus, the above-described embodiment makes use of the interventionless actuator in the context of a well isolation tool and allows for unlimited mechanical opening and closing of ball 116 and a one-time interventionless opening of ball 116 after a predetermined number of pressure cycles to ensure against premature opening, such as during pressure testing.

Figure 9A:
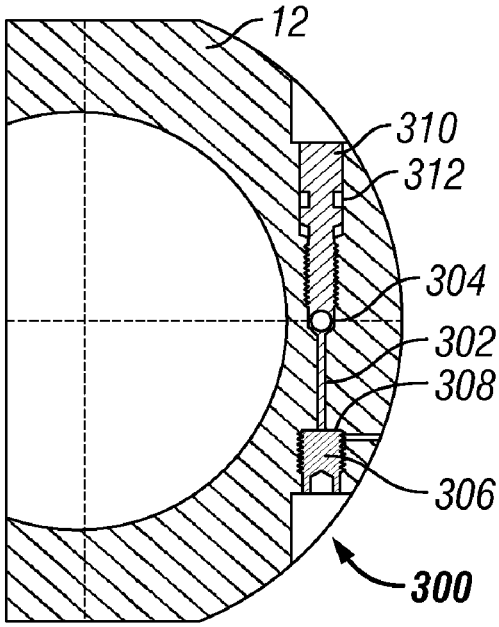
FIGS. 9A and 9B illustrate a gas chamber charging port and an exemplary charging adapter for use in the gas chamber charging port, respectively.
Figure 9B:
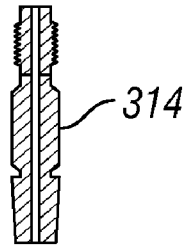

FIG. 9A illustrates a preferred form of a charging port 300 for the gas chamber 28. FIG. 9A is a partial cross sectional view through the housing 12 at a location adjacent the upper and lower chambers 22, 24. A gas pathway comprising first section 302 and second section 304 establishes fluid communication between the outside of the actuator 10 and the gas chamber 28. A charging plug 306 threadingly engages a portion of the fluid pathway and functions to seal the pathway as against the outside environment. A sealing element 308, such as an elastomeric 0-ring, provides the necessary seal. A chamber plug 310 is also provided to intersect and seal off a portion of the fluid pathway between the charging plug 306 and the gas chamber 28. A sealing element 312, such as an elastomeric O-ring, seals the chamber plug cavity against the outside environment. In practice, the charging plug 306 is removed from the housing 12 and a charging adapter 314 is threaded in its place. An energy source, such as compressed nitrogen, may be attached to another end of the charging adapter 314 illustrated generally in FIG. 9B. Chamber plug 310 is unscrewed, but not removed from the housing 12, a sufficient amount to allow fluid communication between the energy source and the gas chamber 28. The gas chamber 28 can then be charged to its first energy level. Once that energy level has been obtained, the chamber plug 310 is seated to seal off the gas chamber 28. The energy source and charging adapter 314 can then be removed and the charging plug 306 reinstalled. In certain embodiments, the chamber plug may comprise a one-way or check valve.

Figure 10:
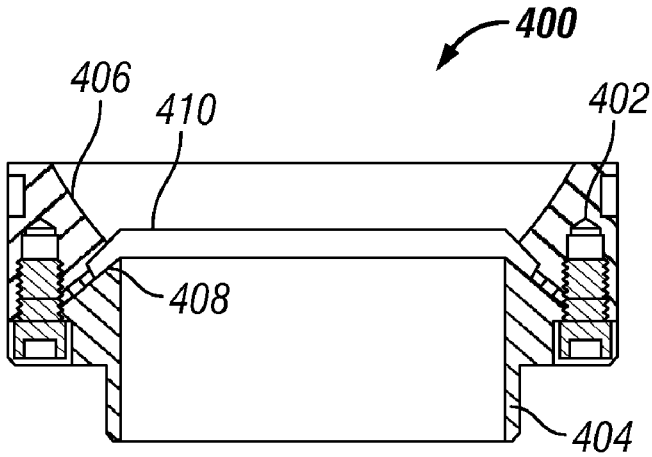
FIG. 10 illustrates an alternative two-piece ball valve seat that may be used with a well isolation tool.

FIG. 10 illustrates a two-piece seat 400 suitable for use with a ball-type well isolation tool, such that the WIT 100 described with reference to FIGS. 3-8. It is preferred that the two-piece seat 400 be used as the down hole seat **118*b* in WIT 100. The seat 400 comprises a high-pressure ball sealing section 402 and a low pressure sealing section 404. The high pressure section 402 comprises a metal seal surface 406 for sealing contact with a ball element, such as ball 116. The low pressure section 404 comprises a recess 408 into which a low-pressure, gas-tight seal 410 may be inserted. In a preferred embodiment of seat 400, the low-pressure seal may be fabricated from PEEK or PEKK, or other suitable material. It will be appreciated by those of skill in the art that the material properties of the low-pressure seal material will dictate how much of the seal may be cantilevered out of the recess 408. In other words, as the amount of pressure differential across the ball 116 increases, the cantilevered height of seal 410 may decrease to avoid premature tearing of the seal 410. As shown in FIG. 10, the low-pressure seal 410 is held in place by sandwiching a portion of the seal 410 (the recessed portion) between the low-pressure seat section 404 and the high-pressure seat section 402**. The two sections may be fastened together in any convenient manner, such as with threaded fasteners.

Alternate embodiments incorporating the benefits of the present invention are readily constructed once the fundamentals described above are understood. For example, shallow depth wells or wells where the anticipated hydrostatic pressure is about 5 kpsi or less may not benefit from an interventionless actuator that has the ability to increase the energy charge down hole. For these situations, the present invention contemplates utilizing a single floating piston, such as, for example actuating piston 36 illustrated in FIGS. 1 and 3-8. In operation, the gas chamber may be charged at the surface to some energy level greater than the anticipated hydrostatic pressure at depth, such as, for example, 5,500 psi for an expected at-depth well pressure of 5,000 psi. When interventionless actuation is desired, the well pressure may be increased to a predetermined amount sufficient to release the actuating piston, such as by shearing a pin or releasing a dog. Once released, the actuating piston may float to equalize the pressure across it and lock itself to an actuating member, such as, for example, the actuating sleeve 14 described above. If an indexing mechanism is utilized, a predetermined number of pressure cycles may advance the mechanism to the actuation cycle so that on the next pressure reduction, the movement of the actuating piston and actuating member cause the corresponding device to be actuated.

Of course, just because an embodiment utilizing the present invention incorporates a second floating piston, such as, for example charging floating piston 26 in FIGS. 1 and 3-8, use of such piston to increase the initial gas charge is not required. In other words, an interventionless actuator having a separate floating charging piston and a separate floating actuating piston may be used in a shallow well where the initial energy charge is sufficient to actuate the corresponding device and the initial charge is, therefore, never raised to a second energy level. In some embodiments utilizing the inventions described herein, it may be desirable to physically lock the floating charging piston in position and allow the field user to unlock the piston, such as by releasing one or more set screws, if increased pressurization down hole is desired for that particular well.

Figure 11:
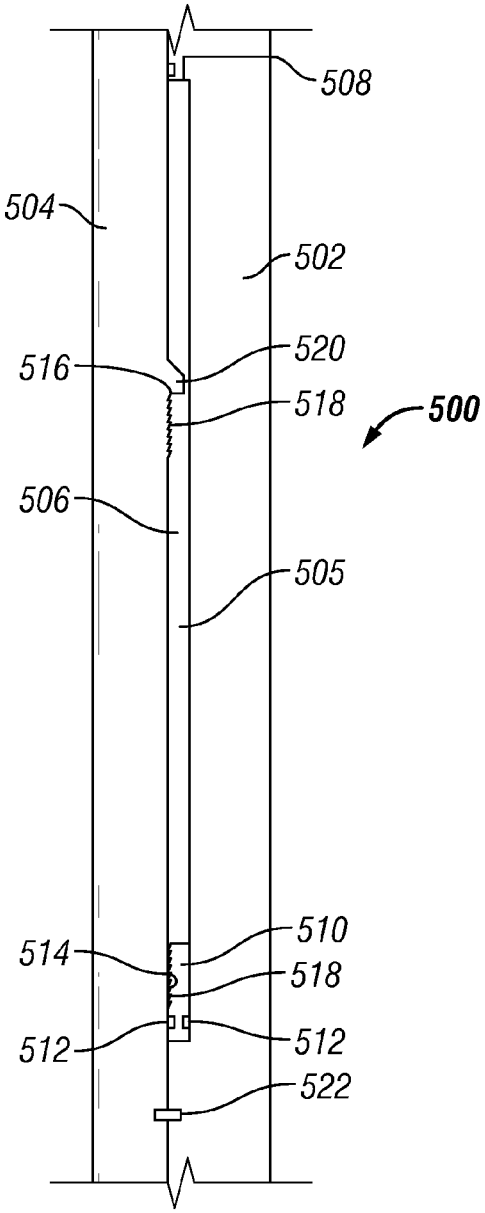
FIG. 11 illustrates another embodiment utilizing the present invention and comprising a combined floating charging piston and floating actuating piston.
Figure 12:
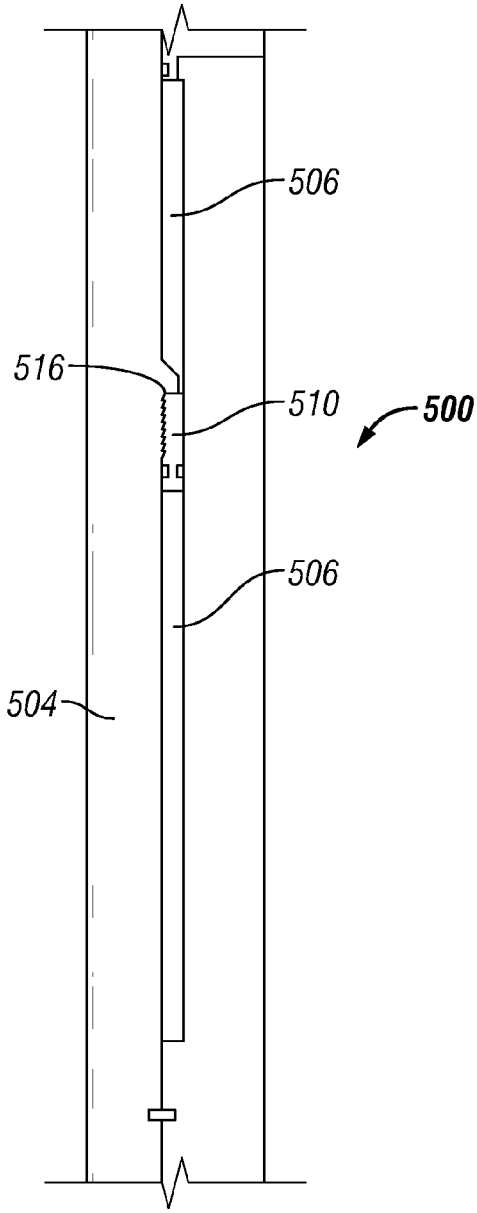
FIG. 12 illustrates the embodiment of FIG. 11 with the gas chamber charged to a second level.
Figure 13:
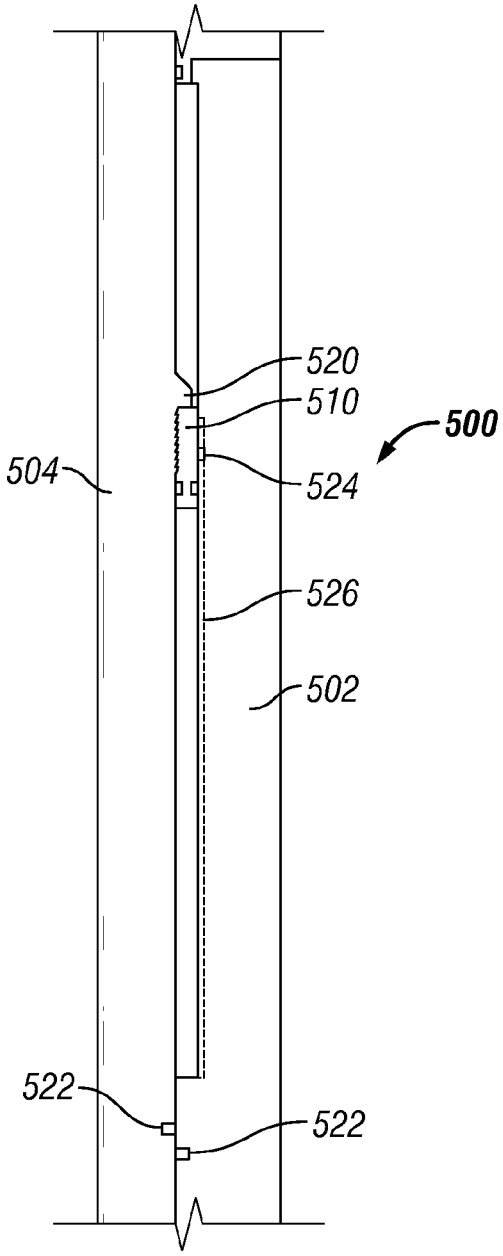
FIG. 13 illustrates the embodiment of FIG. 11 with the actuating member released from the housing.

Another embodiment of an interventionless actuator utilizing the present invention may comprise combining the floating charging piston and the floating actuating piston into one structure. FIGS. 11-13 illustrates one such alternate embodiment. An interventionless actuator 500 is illustrated to comprise a housing 502 and an actuating member 504. A chamber 506 may be formed between the housing 502 and the member 504 and be adapted to contain an energy source, such as compressed nitrogen gas. A charge port 508 may be provided on the housing 502 to provide a sealable entrance communicating the chamber 506 for introducing a compressed gas therein. A floating piston 510 may be disposed with the actuator 500 and preferably within the chamber 506.

The piston 510 may comprise one or more seals 512 to provide a pressure tight seal between the housing 502 and the member 504, thereby creating a pressure tight chamber 505 between the piston 510 and the charge port 508. The piston 510 may also comprise a bidirectional or unidirectional lock portion 514. The actuating member 504 also may comprise a corresponding lock portion 516, such that when lock portions 514 and 516 are adjacent, the piston 510 and the actuating member 504 are locked together in at least one direction. In the embodiment shown in FIG. 11, the lock portions 514, 516 comprise a bi-directional lock and more particularly comprise a set of chevrons or wickers 518 and a positive stop 520. In the initial configuration shown in FIG. 11, the actuating member 504 is releasably fixed to the housing 502 by one or more shearable pins 522. In the field, the actuator 500 may be initially charged to a first energy level by, for example, pressurizing the gas chamber 505 with nitrogen to a level less than the expected well pressure at depth (e.g., 5,000 psi). This initial charge forces the piston 510 to bottom out in its chamber 505 as shown.

During down hole use, the actuator 500 may be charged to a second, greater energy level by increasing the well pressure above the initial charge pressure. Indeed, merely running the actuator 500 to depth may charge the actuator 500 to hydrostatic pressure. Additional well pressurization will charge the actuator 500 to a level greater than hydrostatic pressure. The piston 510 is designed to be responsive to well pressure and floats within the chamber 506 to equalize the well pressure and the nitrogen gas. The actuator 500 illustrated in FIG. 12 has been designed such that a predetermined well pressure (e.g., 10,500 psi) above the hydrostatic well pressure (e.g., 10,000 psi) causes the piston 510 to float toward the lock portion 516 on the actuating member 504. The predetermined well pressure causes the piston 510 and the member 504 to lock together such that the piston/member assembly 510, 504 is adapted to move as a unit. In addition to fixing the two structures together, the nitrogen gas is "locked in" at the second energy level above hydrostatic pressure (e.g., 10,500 psi). The actuator 500 is now charged and ready for interventionless actuation.

To accomplish interventionless actuation of an attached tool or tools (not shown), the actuating member 504 is released from its fixed position to the housing 502. In the embodiment illustrated in FIG. 13, this may be accomplished by pressuring the well to a predetermined level sufficient to release the shear pin 522, such as 13,000 psi. This additional pressurization is reacted by the piston 510, which, in the embodiment shown in FIG. 13, contacts the actuating member stop 520. The resulting force causes the actuating member 504 to move relative to the housing 502 and thereby shear pin 522. Decreasing the well pressurization, such as to the hydrostatic pressurization, causes the piston/actuating member assembly 510, 504 to move relative to the housing 502. This relative movement may be used to actuate one or more associated tools.

As described above for other embodiments utilizing the present invention, the embodiment described above that comprises a combined floating charging piston and a floating actuating piston, may also benefit from an indexing or cycling mechanism to control when the actuator 500 actually actuates a corresponding tool. Indexing mechanism for this and other embodiments may be incorporated between a housing and an actuating member or sleeve as described above, or the indexing mechanism may be incorporated between a floating piston and a housing, or between a floating piston and an actuating member. For example, in the embodiment illustrated in FIGS. 11-13, the floating piston 510 may comprise one or more pins or guides 524 that interface with a track system 526, such as, for example, J-slots, incorporated into housing 502. As the piston 510 floats up hole to equalize the pressures, the guides 524 may follow an initial track to allow engagement of the lock portions 514 and 516. Subsequent pressure cycles allow the index mechanism to advance toward the actuation cycle and may also allow the gas chamber to be charged to its second level. Such embodiments may also benefit from an unloader to release the gas charge after actuation In another embodiment building upon the above disclosure, after interventionless actuation of a WIT, for example, mechanical actuation of the WIT may be used to isolate the well. Thereafter, re-pressurization of the well to about the second energy level causes the floating piston/actuating member assembly 510, 504 to re-engage the indexing mechanism and thereby re-charge the actuator 500 to about the second energy level. The actuator may then be used another time for interventionless actuation.

Figure 14:
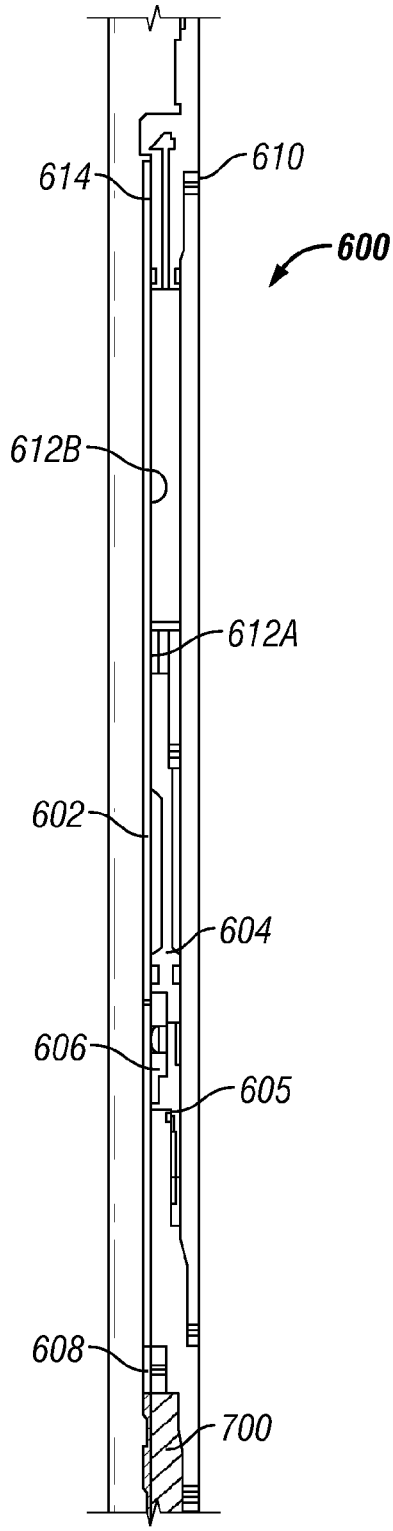
FIG. 14 illustrates another embodiment utilizing the present invention and comprising a combined floating charging piston and floating actuating piston
Figure 15A:
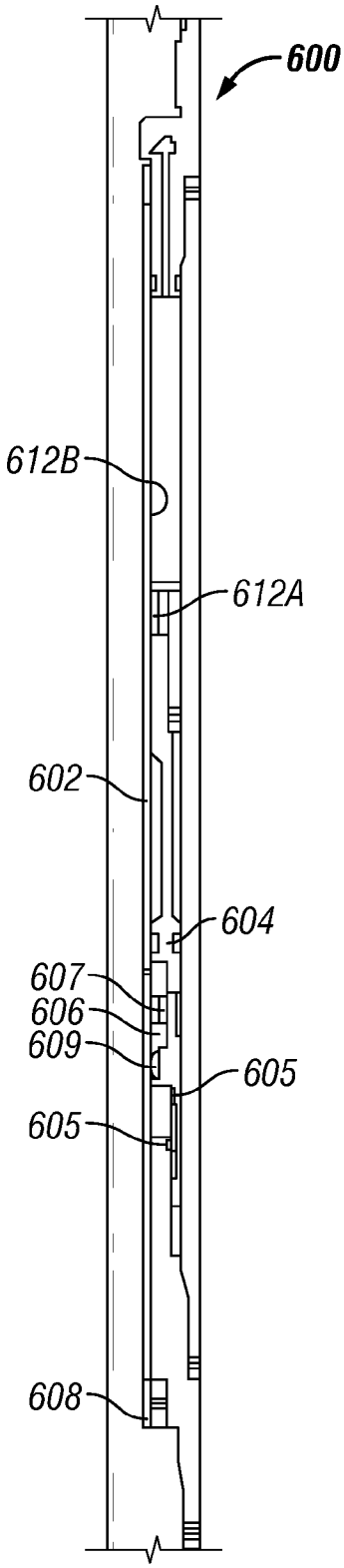
FIG. 15 illustrates three views of the embodiment shown in FIG. 14 during pressure cycling prior to actuation.
Figure 15B:
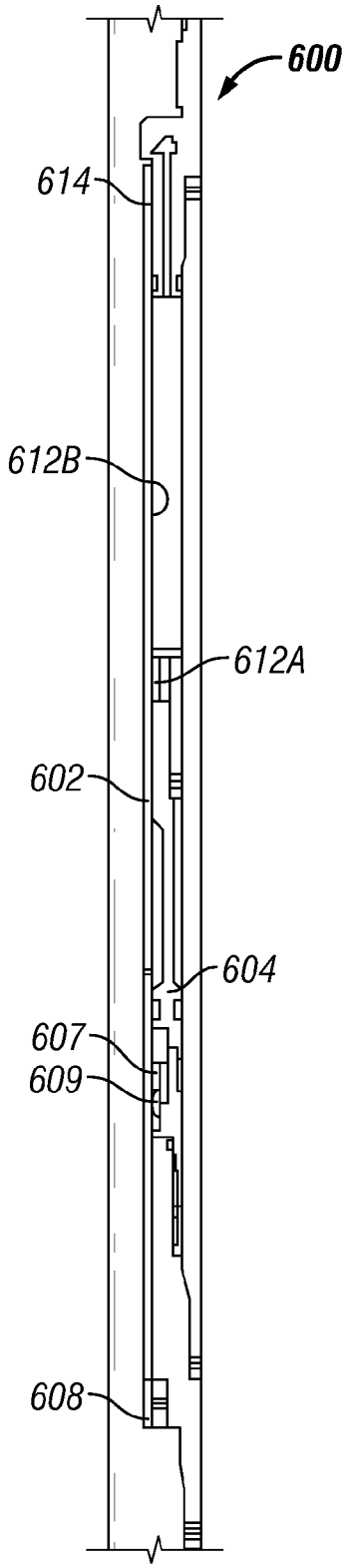
Figure 15C:
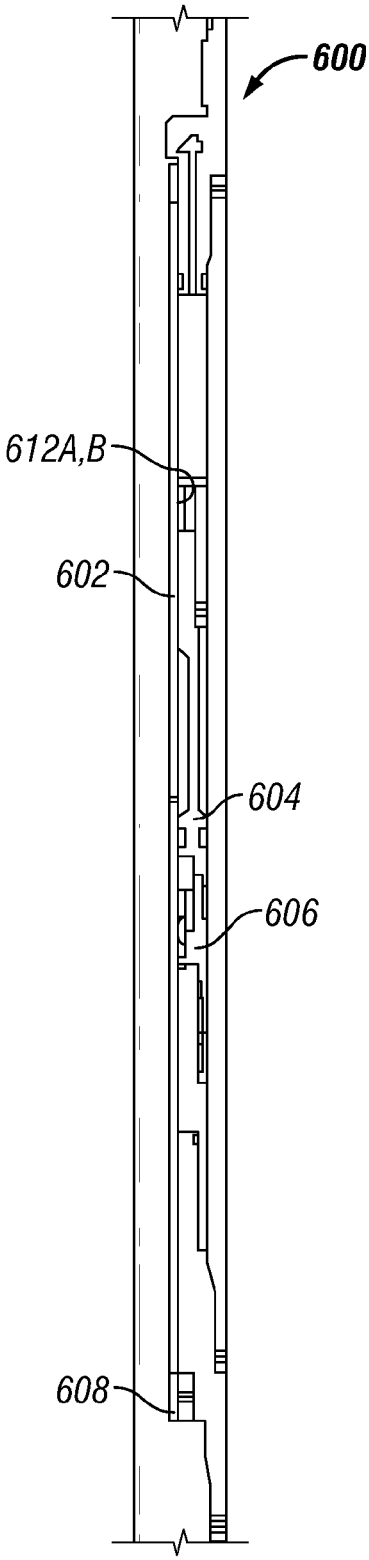
Figure 16:
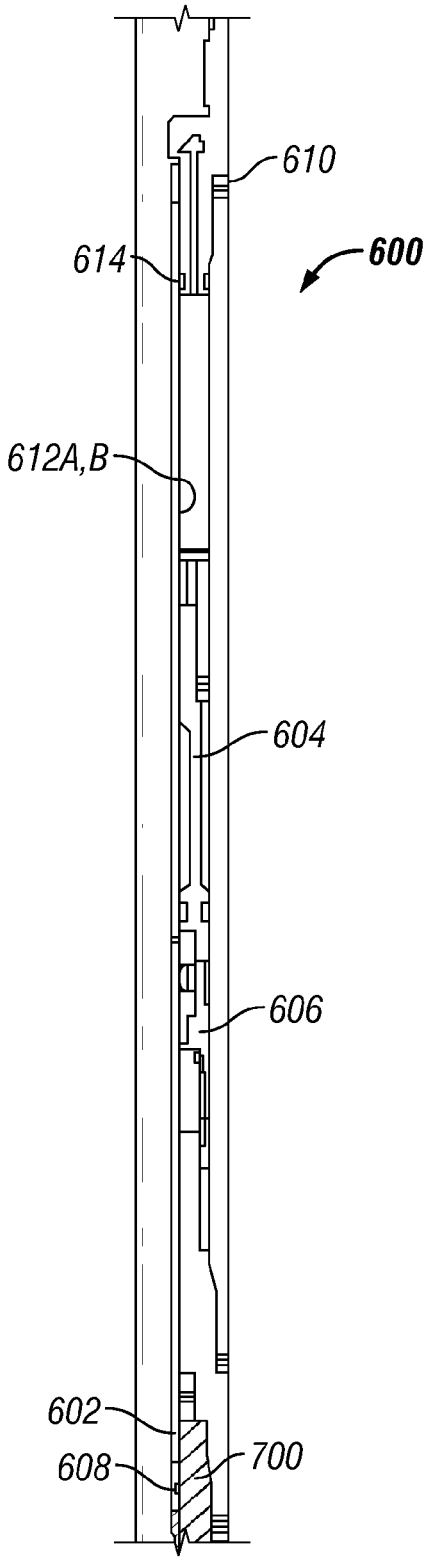
FIG. 16 illustrates the embodiment of FIG. 14 during actuation.

A still further embodiment of the present invention is illustrated in FIGS. 14 through 16. FIG. 14 illustrates an interventionless actuator 600 in an initial condition. The actuator 600 comprises an actuating member 602, a combined floating/actuating piston 604, an actuation mechanism 606 and an actuating member lock 608. The piston 604 may be sealed within a pressure chamber in the actuator 600 and is designed to freely float within the chamber in response to a pressure differential acting upon it. As illustrated in FIG. 14, an upper section of the pressure chamber may be charged with a predetermined amount of compressed gas through port 610. In this embodiment, the piston 604 is initially locked to the actuator 600, such as an outer housing by one or more shearable pins, shearable or releasable rings or dogs. The piston 604 may also comprise one portion, a, of a directional lock 612, such as a uni-directional lock or a bi-directional lock. The corresponding portion, b, to the directional lock 612 may be disposed on the actuating member 602. As illustrated in the initial condition of FIG. 14, the two lock portions 612*a* and 612*b* are not engaged and, therefore, the piston 604 is not locked to the actuating member 602. Also shown in FIG. 14 is an upper portion of a tool 700 to be actuated by actuator 600.

As an example of how this embodiment may be used, assume that a subterranean well has an at-depth pressure of about 3,600 psi. The actuator 600 may be energized at the surface by charging the chamber with a volume of nitrogen gas that will produce an at-depth gas pressure of about 3,600 psi. In other words, an amount of nitrogen gas is charged into the actuator 600 such when the actuator 600 reaches equilibrium at depth (e.g., temperature) the pressure of the nitrogen gas charge will be substantially the same as the well pressure at that depth (e.g., 3.6 kpsi, or a 0 psi differential). Once charged, the actuator 600 and its associated tool 700, such as a well isolation valve, are lowered to depth. Thereafter the isolation valve, such as, for example, a ball valve, may be closed to isolate the well.

As noted above, in the embodiment being described the piston 604 is releasably locked to the actuator 600 by one or more shearable pins or rings 605 having a combined shear rating of about 5,000 psi differential. This allows the operator to test the well string above the tool 700 one or more times below the shear pressure prior to using the actuator 600 to interventionlessly actuate the tool 700 (e.g., re-opening the ball valve).

FIGS. 15*a*, 15*b*, and 15*c* illustrate the operation of this embodiment once the operator has decided to interventionlessly actuate the associated tool 700. FIG. 15*a* illustrates the actuator 600 after the operator has applied about 5,000 psi of wellhead pressure. The 5 kpsi differential between the gas chamber (at about 3.6 kpsi) and the at-depth well pressure (at about 8.6 kpsi) causes the piston lock 605 to release (e.g., to shear). The piston is now free to move and does move in the direction of low pressure, which in this example, is up hole. The extent of up hole movement of the piston 604 (or at least upward movement of the lock portion 612*a*) is limited by the actuation mechanism 606. In this way, the piston release pressurization is not used to engage the lock 612. In this particular embodiment, the actuation mechanism may include an upper ring 607 and a lower ring 609. When the piston is initially released, it travels up hole and displaces upper ring 607 and is retrained by from further up hole movement by lower ring 609. At this point, the lock 612 has not been engaged.

Depressurization of the well, for example, a return to hydrostatic pressure, (illustrated in FIG. 15*b*) forces the piston 604 to travel in a down hole direction, which movement displaces the lower ring 609. The lower ring 609 may be displaced in this manner because the upper ring 607 was previously displaced by up hole movement of the piston 604. The next pressurization of the well will engage the lock 612 and over charge the gas chamber for interventionless actuation.

FIG. 15*c* illustrates the actuator 600 after the last pressurization before interventionless actuation. Depending on the characteristics of the well and the design of actuator 600, the next wellhead pressurization may be to about 3,000 psi (or about 6,600 psi at depth). This pressurization once again causes the piston 604 to move in the direction of low pressure (e.g., up hole). However, this time the travel of the piston 604 is unrestricted by the actuation mechanism 606 and the lock portion 612*a* on piston 604 engages the corresponding lock portion 612*b* on actuating member 602. Thus, actuating member 602 and piston 604 become an integral assembly. Because the piston 604 is locked to the actuating member 602, the pressure in the gas chamber has been overcharged, or increased above the at-depth well pressure. In this example, the overcharge pressure is about 3,000 psi differential. Interventionless actuation of the associated tool 700 is accomplished by releasing the well pressurization, such as, for example by returning the well to its hydrostatic pressure (3,600 psi in this example). The pressure differential between the gas chamber and the well (e.g., 3,000 psi) causes the piston/actuating member assembly to move in the direction of low pressure (now, down hole).

FIG. 16 illustrates the actuator 600 after it has interventionlessly actuated tool 700. The decrease in well pressurization created a pressure differential across the piston 604, which caused the piston 604/actuating member 602 assembly to move in the direction of low pressure. The force caused by the differential pressure may release actuation lock 608, such as by shearing one or more pins or releasing one or more dogs. Once the actuation lock 608 has been released, the actuating member 602 is unrestrained from moving in the actuation direction, here, down hole, and causing the tool 700 to be actuated. This embodiment may also be provided with a compressed gas vent, such as illustrated by port 614, such that upon interventionless actuation of tool 700, the compressed gas chamber is vented to the well. Again, it will be appreciated that while the actuating movement described with respect to the embodiment illustrated in FIGS. 14-16 is axial movement, the present invention may be constructed to provide axial, rotational or a combine axial and rotational actuation motion.

It should noted that the embodiment illustrated in FIGS. 14-16 does not utilize an indexing or cycling mechanism such as described for some of the other disclosed embodiments. This allows the embodiment in FIGS. 14-16 to have an unlimited number of well string test cycles prior to interventionless actuation, including just one. It will be appreciated that the embodiment illustrated in FIGS. 14-16 may be modified in several ways depending on the design parameters of an individual well. For example, the actuator 600 may be constructed such that a well pressurization designed to release the piston 604 from its locked position to the actuator 600 also initiates control of a cycling or indexing mechanism. The cycling mechanism, which includes, but is not limited to the systems described above, may control or limit the movement of, in this embodiment, the piston 604, preventing the piston 604 from lockingly engaging the actuating member 602 until the desired time. The mechanism may be designed to require a specific number of pressure cycles, such as for example, 1, 6 or 9 pressure cycles, or any number in between, before interventionless actuation can be initiated. Once the number of pressure cycles required by the mechanism has been completed, the next well pressurization will overcharge the gas chamber and lock the piston 604 to the actuating member 602.

It will be appreciated by those of ordinary skill in the art that some of the embodiments described herein are more suited for deep, high pressure wells while others are more suited for shallower, lower pressure wells. For example, the embodiment illustrated in FIGS. 14-16 may be particularly beneficial for shallower wells. In all embodiments described herein, the absolute values of well pressure, differential pressure, shear or release loads or pressures used are meant for illustration purposes only and not intended to limit the present invention. Parameters such as these are matter of design choice based on the individual well at issue, the construction of the actuator, the associated tool and the desired actuation all of which are well within the province of a person of ordinary skill in the art having benefit of this disclosure.

Further, features illustrated with respect to the embodiments described herein may have application or utility with another embodiment described herein or with another embodiment of the invention inspired by this disclosure. For example, the embodiments illustrated herein have been described in terms of a housing and a one or more sleeves each having identifiable structural and functional attributes and characteristics. It is well within the scope of the invention to interchange or swap one or more function or structure between the housing and the sleeve. The invention has been described in the context of preferred and other embodiments and not every possible embodiment of the invention has been described. Obvious modifications and alterations to the described embodiments are available to those of ordinary skill in the art. The disclosed and undisclosed embodiments are not intended to limit or restrict the scope or applicability of the invention, but rather, in conformity with the patent laws, this patent is intended to protect all such modifications and improvements to the full extent that such falls within the scope or range of equivalent of the following claims.

What is claimed is:

1. An interventionless actuator for an oil well tool, comprising:

a housing comprising an actuating member fixed relative to the housing and adapted to translate relative to the housing once the fixation is released;

a chamber formed within the housing and adapted to receive a floating piston adapted to move in response to a pressure differential;

a second floating piston initially fixed to the housing;

a directional lock having one portion adjacent the actuating member and another portion adjacent the second piston for locking the second piston and member together at a predetermined time; and wherein the actuating member is translated relative to the housing by a pressure differential acting upon at least the second piston when it is locked to the member.

2. The actuator of claim 1, wherein the pressure differential across the piston is caused by pressurized nitrogen gas on one side and well fluid on the other side.

3. The actuator of claim 1, wherein the chamber is charged in the field an amount of gas greater than the expected well pressure.

4. The actuator of claim 3, wherein the initial gas charge is used to power the actuator.

5. The actuator of claim 4, wherein the pressure of the gas in the chamber is increased to pressure greater than the at-depth well pressure for actuating the tool.

6. The actuator of claim 1, wherein the chamber is charged with an amount of gas less than the expected well pressure.

7. An interventionless actuator for subterranean well equipment, comprising:

a housing comprising an actuating sleeve, the actuating sleeve adapted to physically actuate the equipment;

a fluid chamber disposed in the housing;

a first piston disposed within the chamber and dividing the chamber into a first part for containing well fluid and a second part for containing a compressible fluid;

a second piston disposed within the chamber and releasably fixed in position relative to the housing, the second piston comprising a portion of a lock, which is not engaged when the second piston is in the fixed position;

a corresponding portion of the lock disposed on the actuating sleeve such that when the second piston is freed from its fixed position, the lock portions engage and fix the second piston to the actuating sleeve to form an actuating assembly; and the actuating assembly responsive to differential pressure between the compressible fluid and well fluid pressure to provide interventionless actuation of the equipment.

8. The actuator of claim 7, wherein the equipment is a well isolation tool.

9. The actuator of claim 7, wherein the compressible fluid is nitrogen gas.

10. The actuator of claim 7, wherein the first chamber further comprises a sealable port.

11. The actuator of claim 7, wherein the second chamber comprises a sealable charging port and a vent.

12. The actuator of claim 7, wherein the second chamber is initially filled with a gas to a first pressure level, the first chamber is thereafter filled with a well fluid to a second pressure level greater than the first pressure level.

13. The actuator of claim 12, wherein the first pressure level is less than the expected hydrostatic pressure of the well at depth.

14. The actuator of claim 12, wherein well fluid at a third pressure level greater than the second pressure level causes the second piston to release from its fixed position and lock onto the actuating sleeve.

15. The actuator of claim 14, wherein well fluid pressure at a fourth pressure level less than the second pressure level causes actuation of the device.

16. The actuator of claim 7, further comprising an indexing mechanism that prevents premature actuation of the equipment.

17. An interventionless well isolation tool, comprising:

a first chamber pressurizable to a first level from outside the tool;

a second chamber pressurizable to a second level greater than the first level by well fluids;

a floating piston separating the two chambers and adapted to move within the chambers to equalize the pressures in the two chambers;

a second floating piston releasably locked to the tool, and comprising a working surface and a locking portion; and an actuation member adapted to actuate an isolation element disposed in the tool for isolating a tool flow path, the actuation member having a locking portion adapted to engage the locking portion on the second floating piston when the second piston is unlocked from the tool.

18. The tool of claim 17, wherein the first pressure level is less than the expected hydrostatic pressure at depth.

19. The tool of claim 17, further comprising an indexing mechanism that controls actuation of the tool.

20. The tool of claim 17, wherein the isolation element comprises a ball and seat assembly having bi-directional sealing properties.

21. A method of interventionlessly actuating a subterranean oil well device, comprising:

charging a first chamber to a first pressure level with a compressible fluid;

charging a second chamber to a second pressure level which is greater than the first pressure level;

equalizing the pressures in the first and second chamber across a floating piston located in the chambers;

sealing the equalized pressures in the two chambers;

unlocking a second piston from its initial position;

fixing the second piston to an actuating member;

moving the actuating member in response to a pressure differential acting on the second piston;

actuating the device based on the movement of the actuating member.

22. The method of claim 21, wherein the first pressure level is less than the expected hydrostatic pressure at depth.

23. The method of claim 21, the device is a well isolation tool.

24. The method of claim 23, wherein the well isolation tool comprises a ball and seat valve having bi-directional high pressure seals and a low pressure gastight seal.

25. The method of claim 21, further unlocking the second piston comprises increasing well fluid pressure to a third pressure level greater than the second pressure level.

26. The method of claim 25, further comprising cycling the well fluid pressure between at least two pressure levels a predetermined number of time to cause an indexing mechanism to advance toward device actuation.

* * * * *